US010436490B2

(12) United States Patent
Pham et al.

(10) Patent No.: US 10,436,490 B2
(45) Date of Patent: Oct. 8, 2019

(54) SYSTEM AND METHOD OF CONTROLLING A VARIABLE-CAPACITY COMPRESSOR

(71) Applicant: Emerson Climate Technologies, Inc., Sidney, OH (US)

(72) Inventors: Hung M. Pham, Dayton, OH (US); Shane J. Angle, Piqua, OH (US); Edward J. Trudeau, Jr., Covington, OH (US); Chetan Sowani, Pune (IN)

(73) Assignee: Emerson Climate Technologies, Inc., Sidney, OH (US)

( * ) Notice: Subject to any disclaimer, the term of this patent is extended or adjusted under 35 U.S.C. 154(b) by 422 days.

(21) Appl. No.: 15/196,084

(22) Filed: Jun. 29, 2016

(65) Prior Publication Data

US 2016/0341460 A1 Nov. 24, 2016

Related U.S. Application Data

(63) Continuation of application No. 14/674,980, filed on Mar. 31, 2015, now Pat. No. 10,371,426.
(Continued)

(51) Int. Cl.
*F25B 49/02* (2006.01)
*F25B 13/00* (2006.01)
(Continued)

(52) U.S. Cl.
CPC ..... *F25B 49/022* (2013.01); *F24F 11/83* (2018.01); *F25B 13/00* (2013.01); *F24F 11/46* (2018.01); *F24F 11/58* (2018.01); *F24F 11/61* (2018.01); *F24F 11/65* (2018.01); *F24F 11/85* (2018.01); *F24F 2110/12* (2018.01); *F25B 2313/007* (2013.01); *F25B 2700/2104* (2013.01); *F25B 2700/2106* (2013.01)

(58) Field of Classification Search
CPC combination set(s) only.
See application file for complete search history.

(56) References Cited

U.S. PATENT DOCUMENTS 4,228,846 A 10/1980 Smorol
4,248,053 A 2/1981 Sisk
(Continued)

FOREIGN PATENT DOCUMENTS

CN 1272171 A 11/2000
CN 1573261 A 2/2005
(Continued)

OTHER PUBLICATIONS

International Search Report regarding International Application No. PCT/US2015/023889, dated Jul. 14, 2015.
(Continued)

*Primary Examiner* — Elizabeth J Martin
(74) *Attorney, Agent, or Firm* — Harness, Dickey & Pierce, P.L.C.

(57) ABSTRACT

A working-fluid circuit may include an indoor heat exchanger, a variable-capacity compressor and a control module. The variable-capacity compressor pumps working fluid through the indoor heat exchanger. The control module may control the compressor and operate the compressor in one of a first capacity mode and a second capacity mode based on a demand signal, outdoor-air-temperature data and a compressor runtime.

10 Claims, 8 Drawing Sheets

Related U.S. Application Data

(60) Provisional application No. 61/973,528, filed on Apr. 1, 2014.

(51) Int. Cl.

| | |
|---|---|
| ***F24F 11/83*** | (2018.01) |
| ***F24F 110/12*** | (2018.01) |
| ***F24F 11/65*** | (2018.01) |
| ***F24F 11/58*** | (2018.01) |
| ***F24F 11/61*** | (2018.01) |
| ***F24F 11/46*** | (2018.01) |
| ***F24F 11/85*** | (2018.01) |

(56) References Cited

U.S. PATENT DOCUMENTS

| | | | | |
|---|---|---|---|---|
| 4,419,866 | A | 12/1983 | Howland | |
| 4,494,382 | A | 1/1985 | Raymond | |
| 4,718,247 | A | 1/1988 | Kobayashi et al. | |
| 5,078,318 | A | 1/1992 | Kawai et al. | |
| 5,271,556 | A | 12/1993 | Helt et al. | |
| 5,385,453 | A | 1/1995 | Fogt et al. | |
| 5,806,760 | A | 9/1998 | Maiello | |
| 6,058,729 | A | 5/2000 | Lifson et al. | |
| 6,134,901 | A | 10/2000 | Harvest et al. | |
| 6,213,731 | B1 | 4/2001 | Doepker et al. | |
| 6,370,894 | B1 | 4/2002 | Thompson et al. | |
| 6,389,822 | B1 | 5/2002 | Schanin | |
| 6,389,823 | B1 | 5/2002 | Loprete et al. | |
| 6,679,072 | B2 | 1/2004 | Pham et al. | |
| 6,843,425 | B2 | 1/2005 | Lee | |
| 7,228,694 | B2 | 6/2007 | Schwarz et al. | |
| 7,455,238 | B2 | 11/2008 | Hugghins | |
| 7,458,227 | B2 | 12/2008 | Lee et al. | |
| 7,513,123 | B2 | 4/2009 | Lee et al. | |
| 7,513,124 | B2 | 4/2009 | Lee et al. | |
| 7,628,028 | B2 | 12/2009 | Tolbert, Jr. et al. | |
| 7,946,123 | B2 | 5/2011 | Tolbert, Jr. et al. | |
| 8,011,199 | B1 | 9/2011 | Chen et al. | |
| 8,459,053 | B2 | 6/2013 | Pham et al. | |
| 8,485,789 | B2 | 7/2013 | Gu et al. | |
| 8,585,382 | B2 | 11/2013 | Akei et al. | |
| 8,601,828 | B2 | 12/2013 | Moseley | |
| 8,616,014 | B2 | 12/2013 | Stover et al. | |
| 9,074,787 | B2 | 7/2015 | Kitagishi et al. | |
| 2002/0088240 | A1 | 7/2002 | Shi et al. | |
| 2006/0032253 | A1* | 2/2006 | Lee | F25B 49/022 62/175 |
| 2006/0283965 | A1 | 12/2006 | Mueller et al. | |
| 2007/0214817 | A1 | 9/2007 | Inaba | |
| 2007/0227167 | A1 | 10/2007 | Shapiro | |
| 2008/0073440 | A1 | 3/2008 | Butler et al. | |
| 2010/0218527 | A1 | 9/2010 | Kitagishi et al. | |
| 2010/0236264 | A1 | 9/2010 | Lifson et al. | |
| 2012/0090337 | A1* | 4/2012 | Chen | F25B 30/02 62/79 |
| 2013/0025304 | A1 | 1/2013 | Dorman | |
| 2013/0186111 | A1 | 7/2013 | Kim et al. | |
| 2014/0088777 | A1* | 3/2014 | Allmaras | H02J 3/32 700/295 |
| 2014/0196489 | A1 | 7/2014 | Emo et al. | |
| 2015/0276291 | A1 | 10/2015 | Pham et al. | |
| 2016/0018147 | A1 | 1/2016 | Guo | |

FOREIGN PATENT DOCUMENTS

| | | | |
|---|---|---|---|
| CN | 1671967 | A | 9/2005 |
| CN | 1734196 | A | 2/2006 |
| CN | 101103201 | A | 1/2008 |
| DE | 102011079205 | A1 | 1/2013 |
| EP | 0127559 | A1 | 12/1984 |
| EP | 1241417 | A1 | 9/2002 |
| EP | 1684025 | A1 | 7/2006 |
| JP | H04214158 | A | 8/1992 |
| JP | 2745836 | B2 | 4/1998 |
| JP | 2002061925 | A | 2/2002 |
| KR | 100661919 | B1 | 12/2006 |

OTHER PUBLICATIONS

Written Opinion of the International Searching Authority regarding International Application No. PCT/US2015/023889, dated Jul. 14, 2015.

Non-Final Office Action regarding U.S. Appl. No. 14/674,980 dated Feb. 6, 2018.

Notice of Allowance regarding U.S. Appl. No. 14/734,115, dated May 17, 2018.

Office Action regarding Korean Application No. 10-2016-7030477, dated May 30, 2018. Translation provided by Y.S. Chang & Associates.

Office Action regarding European Patent Application No. 15772694.4, dated Jun. 21, 2018.

Office Action regarding Chinese Patent Application No. 201580031036.9, dated Jul. 4, 2018. Translation provided by Unitalen Attorneys at Law.

Final Office Action regarding U.S. Appl. No. 14/674,980, dated Jul. 27, 2018.

Office Action regarding Indian Patent Application No. 1491/MUM/2014, dated Aug. 29, 2018.

Office Action regarding Korean Patent Application No. 10-2016-7030477, dated Mar. 27, 2018. Translation provided by Y.S. Chang & Associates.

Office Action regarding Chinese Patent Application No. 201580018201.7, dated Nov. 9, 2017. Translation provided by Unitalen Attorneys at Law.

Restriction and Election of Species Requirement regarding U.S. Appl. No. 14/674,980, dated Oct. 4, 2017.

Office Action regarding South Korean Patent Application No. 10-2016-7030477, dated Sep. 18, 2017. Translation provided by Y.S. Chang & Associates.

Search Report regarding European Patent Application No. 15772694.4, dated Oct. 19, 2017.

"38TDA Two-Speed Air Conditioning Unit—Installation and Start-Up Instructions." Carrier Heating and Cooling. Catalog No. 563-707. Form 38TDA-2SI. Nov. 1998.

"Installer's System Setup Guide." Lennox Industries, Inc. Sep. 2012.

International Search Report regarding International Application No. PCT/US2015/034862, dated Sep. 17, 2015.

Written Opinion of the International Searching Authority regarding International Application No. PCT/US2015/034862, dated Sep. 17, 2015.

Restriction Requirement regarding U.S. Appl. No. 14/734,115, dated Jul. 14, 2017.

Office Action regarding U.S. Appl. No. 14/734,115, dated Oct. 12, 2017.

Office Action regarding Chinese Patent Application No. 201580018201.7, dated Apr. 12, 2017. Translation provided by Unitalen Attorneys at Law.

Office Action regarding U.S. Appl. No. 14/674,980, dated Oct. 23, 2018.

Office Action regarding European Patent Application No. 15772694.4, dated Jan. 7, 2019.

* cited by examiner

231

| T1' | Comfort Level | | | | |
|---|---|---|---|---|---|
| | 1 | 2 | 3 | 4 | 5 |
| Outdoor temperature | | | | | |
| 60-69 | 70 | 50 | 40 | 30 | 10 |
| 70-79 | 60 | 40 | 30 | 20 | 5 |
| 80-89 | 50 | 30 | 20 | 10 | 1 |
| 90+ | 40 | 20 | 15 | 10 | 1 |

FIG. 6

233

| T2' | Comfort Level | | | | |
|---|---|---|---|---|---|
| | 1 | 2 | 3 | 4 | 5 |
| Outdoor temperature | | | | | |
| 60-69 | 1 | 20 | 30 | 40 | 60 |
| 70-79 | 10 | 30 | 40 | 50 | 65 |
| 80-89 | 20 | 40 | 50 | 60 | 70 |
| 90+ | 30 | 50 | 55 | 60 | 70 |

FIG. 7

SYSTEM AND METHOD OF CONTROLLING A VARIABLE-CAPACITY COMPRESSOR

CROSS-REFERENCE TO RELATED APPLICATIONS

This application is a continuation of U.S. application Ser. No. 14/674,980, filed Mar. 31, 2015, which claims the benefit of U.S. Provisional Application No. 61/973,528, filed on Apr. 1, 2014, and Indian Patent Application No. 1491/MUM/2014, filed Apr. 29, 2014. The entire disclosures of the above applications are incorporated herein by reference.

FIELD

The present disclosure relates to a climate-control system having a variable-capacity compressor.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Varying a capacity of the compressor can impact the energy-efficiency of the system and the speed with which the system is able to heat or cool a room or space.

SUMMARY

This section provides a general summary of the disclosure, and is not a comprehensive disclosure of its full scope or all of its features.

In one form, the present disclosure provides a climate-control system including a variable-capacity compressor unit and a control module controlling the compressor unit. The compressor unit may be operable in a first capacity mode and in a second capacity mode that is higher than the first capacity mode. The control module may be configured to switch the compressor unit among a shutdown state, the first capacity mode and the second capacity mode based on a demand signal and outdoor-air-temperature data. The control module may include outdoor-air-temperature-sensing and demand-signal-sensing circuitry.

In some embodiments, the control module receives the demand signal from a single-stage thermostat disposed within a space to be cooled by the climate-control system.

In some embodiments, the climate-control system may include an indoor heat exchanger receiving working fluid from the compressor unit and a blower forcing air into a convective heat transfer relationship with working fluid in the indoor heat exchanger. The blower may include a fixed-speed motor or a variable-speed motor operable at a selectable fixed speed tap, for example.

In some embodiments, the control module switches the compressor unit between the first and second capacity modes based on a compressor runtime.

In some embodiments, the compressor runtime is a runtime of the compressor unit in the second capacity mode.

In some embodiments, the runtime of the compressor unit in the second capacity mode is equal to a previous runtime in the second capacity mode during a previous demand period. That is, the runtime of the compressor unit in the second capacity mode may be adaptively compared from cycle-to-cycle to a previous runtime in the second capacity mode.

In some embodiments, the control module switches the compressor unit from the first capacity mode to the second capacity modes based on whether the previous runtime was greater than five minutes.

In some embodiments, the control module switches the compressor unit from the first capacity mode to the second capacity modes based on whether the compressor unit has been operating in the first capacity mode for greater than a predetermined time period.

In some embodiments, the climate-control system includes a comfort control interface configured to be positioned at one of a plurality of comfort level settings. A first one of the comfort level settings may correspond to an energy-efficiency operating mode and a second one of the comfort level settings may correspond to a high-performance operating mode.

In some embodiments, the control module is configured to compare the compressor runtime with a low-capacity runtime threshold and a high-capacity runtime threshold.

In some embodiments, the control module is configured to switch the compressor between the low-capacity mode and the high-capacity mode based on the comparison of the compressor runtime with the first capacity runtime and based on the comparison of the compressor runtime with the second capacity runtime.

In some embodiments, the low-capacity runtime threshold and the high-capacity runtime threshold are determined based on a selected one of the comfort level settings.

In some embodiments, the control module operates the compressor unit in one of the first and second capacity modes based only on the demand signal, the outdoor-air-temperature data and at least one compressor runtime.

In some embodiments, the at least one compressor runtime is a runtime of the compressor unit in the second capacity mode.

In some embodiments, the compressor unit includes only one compressor (e.g., a variable-capacity compressor). In other embodiments, the compressor unit could include a plurality of variable-capacity and/or fixed-capacity compressors.

In another form, the present disclosure provides a method of controlling a compressor operable in a first capacity mode and in a second capacity mode that is higher than the first capacity mode. The method may include receiving a demand signal from a thermostat; setting a low-capacity runtime threshold value based on a user-selected comfort level; operating the compressor in a low-capacity mode in response to receipt of the demand signal; comparing a runtime of the compressor to the low-capacity runtime threshold value; and switching the compressor from the low-capacity mode to a high-capacity mode based on the comparison of the runtime and the low-capacity runtime threshold value.

In some embodiments, the method includes setting a high-capacity runtime threshold value based on the user-selected comfort level.

In some embodiments, the method includes switching the compressor from the high-capacity mode to the low-capacity mode based on the comparison of the runtime and the high-capacity runtime threshold value.

In another form the present disclosure provides a method of controlling a compressor. The compressor may be operable in a first capacity mode and in a second capacity mode that is higher than the first capacity mode. The method may include receiving a demand signal from a thermostat; comparing an outdoor air temperature with a predetermined temperature value; comparing a runtime of the compressor to a predetermined runtime value; and operating the compressor in response to receipt of the demand signal in one of the first and second capacity modes based on the comparison of the outdoor air temperature and the predetermined temperature value and the comparison of the runtime and the predetermined runtime value.

In some embodiments, the method includes operating the compressor only in the first capacity mode until demand is satisfied if the outdoor air temperature is less than the predetermined temperature value and if a total runtime of the compressor since receipt of the demand signal is less than the predetermined runtime value.

In some embodiments, the method includes switching the compressor from the first capacity mode to the second capacity mode based on the comparison between the runtime and the predetermined runtime value.

In some embodiments, the method includes operating the compressor in the first capacity mode until the runtime exceeds the predetermined runtime value and switching the compressor from the first capacity mode after the runtime exceeds the predetermined runtime value.

In some embodiments, the predetermined runtime value is a previous amount of time over which the compressor previously operated in the second capacity mode spanning from an initiation of the second capacity mode until satisfaction of a previous demand signal.

In some embodiments, the compressor is operated in one of the first and second capacity modes based only on the demand signal, the outdoor-air-temperature and at least one compressor runtime.

In another form, the present disclosure provides a working-fluid circuit that may include indoor and outdoor heat exchangers, an expansion device, a variable-capacity compressor and a control module. The outdoor heat exchanger may be in fluid communication with the indoor heat exchanger. The expansion device may be disposed between the indoor and outdoor heat exchangers. The variable-capacity compressor may circulate working fluid between the indoor and outdoor heat exchangers. The control module may control the compressor and operate the compressor in one of a low-capacity mode and a high-capacity mode based on a demand signal, outdoor-air-temperature data and a compressor runtime.

In some embodiments, the working-fluid circuit includes a single-stage thermostat in communication with the control module and configured to generate the demand signal. The demand signal is generic to operation in the first and second capacity modes.

In some embodiments, the working-fluid circuit includes an indoor blower configured to force air into a convective heat transfer relationship with the indoor heat exchanger. The indoor blower has a fixed-speed motor.

In some embodiments, the control module switches the compressor between the first and second capacity modes based on another compressor runtime.

In some embodiments, the working-fluid circuit includes a comfort control interface configured to be positioned at one of a plurality of comfort level settings. A first one of the comfort level settings may correspond to an energy-efficiency operating mode and a second one of the comfort level settings may correspond to a high-performance operating mode.

In some embodiments, the control module is configured to compare the compressor runtime with a first capacity runtime threshold and a second capacity runtime threshold.

In some embodiments, the control module is configured to switch the compressor between the first and second capacity modes based on the comparison of the compressor runtime with the first capacity runtime and based on the comparison of the compressor runtime with the second capacity runtime.

In some embodiments, the first capacity runtime threshold and the second capacity runtime threshold are determined based on a selected one of the comfort level settings.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 6 is a lookup table including low-capacity runtime threshold values for given comfort levels and given outdoor ambient-air-temperatures;

FIG. 7 is a lookup table including high-capacity runtime threshold values for given comfort levels and given outdoor ambient-air-temperatures;

Corresponding reference numerals indicate corresponding parts throughout the several views of the drawings.

DETAILED DESCRIPTION

Figure 1:
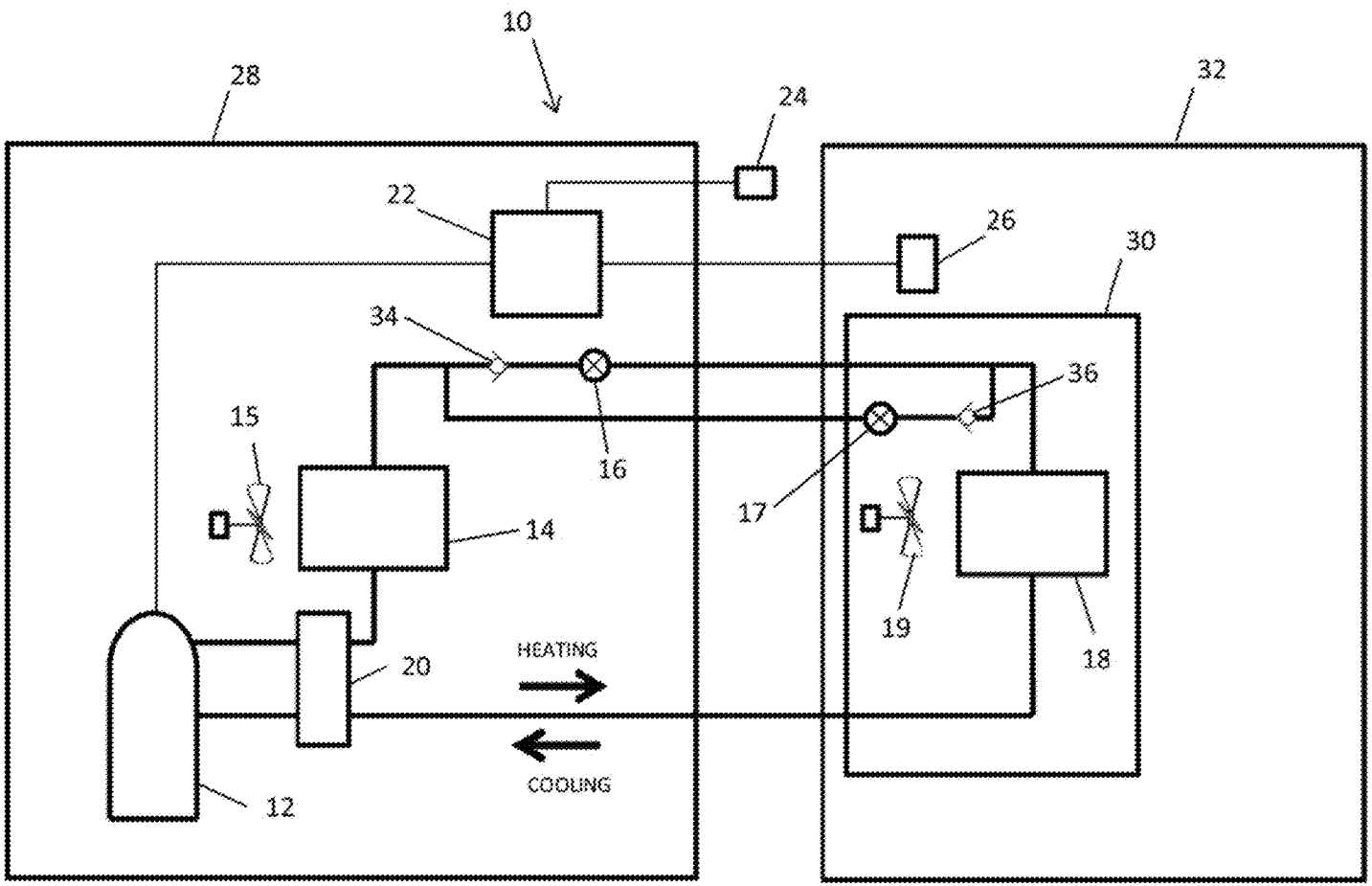
FIG. 1 is a schematic representation of a heat-pump system having a variable-capacity compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a system 10 is provided that may include a variable-capacity compressor (or a variable-capacity group of compressors) 12, an outdoor heat exchanger 14, an outdoor blower 15, a first expansion device 16, a second expansion device 17, an indoor heat exchanger 18, and an indoor blower 19. In the particular configuration shown in FIG. 1, the system 10 is a heat-pump system having a reversing valve 20 operable to control a direction of working fluid flow through the system 10 to switch the system 10 between a heating mode and a cooling mode. In some configurations, the system 10 may be an air-conditioning system or a refrigeration system, for example, and may be operable in only the cooling mode. As will be described in more detail below, a control module 22 may control operation of the compressor 12 and may switch the compressor 12 between a low-capacity mode and a high-capacity mode based on data received from an outdoor-air-temperature sensor 24, a signal received from a thermostat 26, a comparison between a runtime T of the compressor 12 and a predetermined low-capacity runtime threshold T1, and a comparison between a previous high-capacity runtime threshold T2 with a predetermined value. The control module 22 may minimize or reduce employment of high-capacity-mode operation to minimize or reduce energy usage while maintaining an acceptable level of comfort within a space to be heated or cooled.

The compressor 12 can be or include a scroll compressor, a reciprocating compressor, or a rotary vane compressor, for example, and/or any other type of compressor. The compressor 12 may be any type of variable-capacity compressor that is operable in at least a low-capacity mode and a high-capacity mode. For example, the compressor 12 may be or include a multi-stage compressor, a group of independently operable compressors, a multi-speed or variable-speed compressor (having a variable-speed or multi-speed motor), a compressor having modulated suction (e.g., blocked suction), a compressor having fluid-injection (e.g., an economizer circuit), a pulse-width-modulated scroll compressor configured for scroll separation (e.g., a digital scroll compressor), a compressor having variable-volume-ratio valves configured to leak intermediate-pressure working fluid, or a compressor having two or more of the above capacity modulation means. It will be appreciated that the compressor 12 could include any other additional or alternative structure for varying its capacity and/or the operating capacity of the system 10. It will be appreciated that the low-capacity and/or high-capacity modes may be continuous, steady-state operating modes, or compressor 12 may be modulated (e.g., pulse-width-modulated) during operation in the low-capacity mode and/or during operation in the high-capacity mode. Exemplary variable-capacity compressors are disclosed in assignee's commonly owned U.S. Pat. Nos. 8,616,014, 6,679,072, 8,585,382, 6,213,731, 8,485,789, 8,459,053, and 5,385,453, the disclosures of which are hereby incorporated by reference.

The compressor 12, the outdoor heat exchanger 14, the outdoor blower 15, the first expansion device 16 and the reversing valve 20 may be disposed in an outdoor unit 28. The second expansion device 17, the indoor heat exchanger 18 and the indoor blower 19 may be disposed within an indoor unit 30 (e.g., an air handler or furnace) disposed within a home or other building 32. A first check valve 34 may be disposed between outdoor heat exchanger 14 and the first expansion device 16 and may restrict or prevent fluid flow through the first expansion device 16 in the cooling mode and may allow fluid flow through the first expansion device 16 in the heating mode. A second check valve 36 may be disposed between the second expansion device 17 and the indoor heat exchanger 18 and may restrict or prevent fluid flow through the second expansion device 17 in the heating mode and may allow fluid flow through the second expansion device 17 in the cooling mode.

The outdoor-air-temperature sensor 24 is disposed outside of the building 32 and within or outside of the outdoor unit 28 and is configured to measure an outdoor ambient air temperature and communicate the outdoor ambient air temperature value to the control module 22 intermittently, continuously or on-demand. In some configurations, the outside-air-temperature sensor 24 could be a thermometer or other sensor associated with a weather monitoring and/or weather reporting system or entity. In such configurations, the control module 22 may obtain the outdoor-air temperature (measured by the sensor 24) from the weather monitoring and/or weather reporting system or entity via, for example, an internet, Wi-Fi, Bluetooth®, Zigbee®, power-line carrier communication (PLCC), or cellular connection or any other wired or wireless communication protocol. For example, the control module 22 may communicate with the weather monitoring and/or weather reporting system or entity over the internet via a Wi-Fi connection to a Wi-Fi router located in or associated with the building 32. The thermostat 26 is disposed inside of the building 32 and outside of the indoor unit 30 and is configured to measure an air temperature within a room or space to be cooled or heated by the system 10. The thermostat 26 can be a single-stage thermostat, for example, that generates only one type of demand signal in response to a temperature within the room or spaced rising above (in the cooling mode) or falling below (in the heating mode) a setpoint temperature. The control module 22 could be disposed in any suitable location, such as inside of or adjacent to the outdoor unit 28 or inside of or adjacent to the indoor unit 30, for example.

In the cooling mode, the outdoor heat exchanger 14 may operate as a condenser or as a gas cooler and may cool discharge-pressure working fluid received from the compressor 12 by transferring heat from the working fluid to air forced over the outdoor heat exchanger 14 by the outdoor blower 15, for example. The outdoor blower 15 could include a fixed-speed, multi-speed or variable-speed fan. In the cooling mode, the indoor heat exchanger 18 may operate as an evaporator in which the working fluid absorbs heat from air forced over the indoor heat exchanger 18 by the indoor blower 19 to cool a space within the home or building 32. The indoor blower 19 could include a fixed-speed, multi-speed or variable-speed fan. In the heating mode, the outdoor heat exchanger 14 may operate as an evaporator, and the indoor heat exchanger 18 may operate as a condenser or as a gas cooler and may transfer heat from working fluid discharged from the compressor 12 to a space to be heated.

Figure 2:
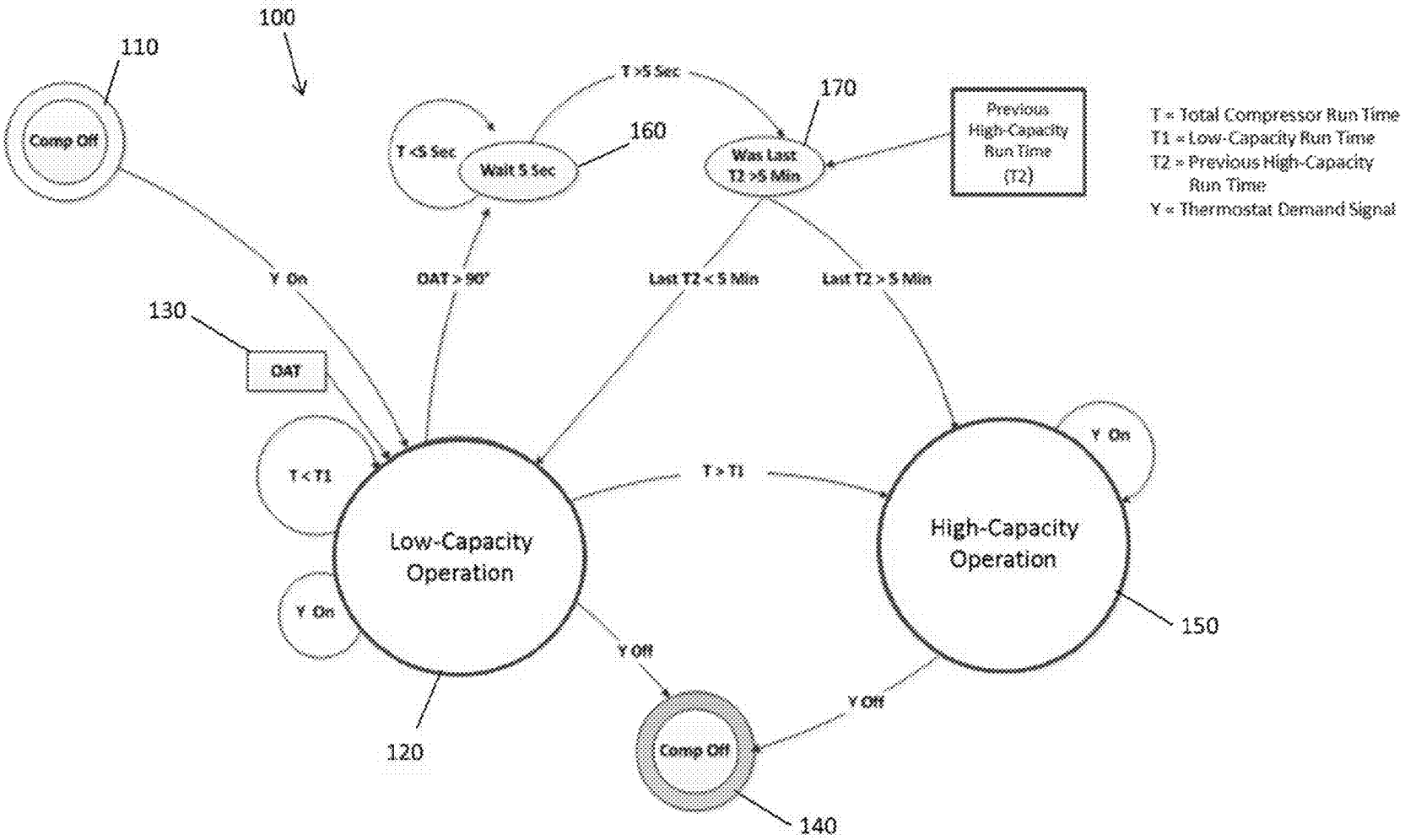
FIG. 2 is a state diagram illustrating a method and algorithm for controlling the variable-capacity compressor of FIG. 1.

With reference to FIGS. 1 and 2, a method and control algorithm 100 of the control module 22 will be described. The algorithm 100 may control operation of the compressor 12 and switch the compressor 12 between the low-capacity and high-capacity modes. In an initial state 110, the compressor 12 may be off. The thermostat 26 may send a demand signal Y to the control module 22 in response to an air temperature in the space to be heated or cooled by the system 10 dropping below (in the heating mode) or rising above (in the cooling mode) a selected setpoint temperature. In response to receipt of the demand signal Y, the control module 22 may initiate operation of the compressor 12 in the low-capacity mode (state 120). Initiating operation of the compressor 12 in the low-capacity mode may reduce or minimize an in-rush of energy and mechanical stress during start-up of the compressor 12.

The control module 22 may receive the outdoor ambient air temperature measured by the sensor 24 (input 130) and, when the system 10 is in the cooling mode, determine whether the outdoor ambient air temperature is above a first predetermined temperature value (such as ninety degrees Fahrenheit, for example). If the outdoor ambient air temperature is less than the first predetermined temperature value, then the control module 22 may continue to operate the compressor in the low-capacity mode (state 120) until the cooling demand is satisfied (i.e., the temperature in the space to be cooled drops below the selected setpoint temperature as indicated by the thermostat 26 and the thermostat switches the demand signal Y to "off"), until the total runtime T of the compressor 12 since the receipt of the demand signal Y surpasses a predetermined low-capacity runtime T1, or until the compressor 12 or system 10 is manually shutdown or a diagnostic or protection algorithm overrides the algorithm 100. The predetermined low-capacity runtime T1 could be approximately forty minutes, for example. If demand is satisfied before the total runtime T reaches the predetermined low-capacity runtime T1, the control module 22 may shutdown the compressor 12 (state 140). The first predetermined temperature value may be chosen to minimize runtime in the high-capacity mode in many or most houses or buildings in many or most weather conditions for one or more geographical locations. The predetermined low-capacity runtime T1 may be chosen to avoid running the low-capacity mode longer than would be desirable for comfort and/or to prevent prematurely switching to the high-capacity mode (which would use more energy than would be desirable). In some embodiments and under some circumstances, it may be expected that the compressor 12 could run in the low-capacity mode for a majority (e.g., 80% or more) of a cooling season (e.g., summer) for many or most houses or buildings in many or most climates or geographical regions.

If the compressor 12 has been running for longer than the predetermined low-capacity runtime T1 without satisfying the demand, the control module 22 may switch the compressor 12 from the low-capacity mode to the high-capacity mode (state 150). The compressor 12 may continue to run in the high-capacity mode until the cooling demand is satisfied (or until the compressor 12 or system 10 is manually shutdown or a diagnostic or protection algorithm overrides the algorithm 100). When demand is satisfied, the control module 22 may shutdown the compressor 12 (state 140) instead of switching back to the low-capacity mode. When the compressor 12 is shut down after satisfying demand by operating in the high-capacity mode, the control module 22 may record the runtime T2 of the compressor 12 in the high-capacity mode and store the runtime T2 in a memory module (not shown) associated with the control module 22.

After initially starting the compressor 12 in the low-capacity mode in response to the initial receipt of the demand signal Y, if the control module 22 determines that the outdoor ambient air temperature is at or above the first predetermined temperature value, the control module 22 may wait (state 160) and allow the compressor 12 to continue operating in the low-capacity mode for a predetermined waiting period (e.g., about five seconds). The predetermined waiting period may be chosen to ensure a stable start-up of the compressor 12 without significantly impacting overall system capacity and/or the system's ability to control comfort. After the predetermined waiting period ends, the control module 22 may determine whether the last runtime T2 of the compressor 12 in the high-capacity mode was more than a predetermined time period (e.g., about five minutes)(state 170). This predetermined time period may be chosen to determine whether the thermal load of the house or building 32 is high enough that a switch to the high-capacity mode is necessary or desirable to achieve desired comfort or low enough to continue operation in the low-capacity mode and still achieve desired comfort control. If the last high-capacity runtime T2 was greater than or equal to the predetermined time period, the control module 22 may switch the compressor 12 from the low-capacity mode (state 120) to the high-capacity mode (state 150). Thereafter, the compressor 12 may continue to run in the high-capacity mode until the cooling demand is satisfied (or until the compressor 12 or system 10 is manually shutdown or a diagnostic or protection algorithm overrides the algorithm 100). When the cooling demand is satisfied, the control module 22 may shutdown the compressor 12 (state 140).

If the last high-capacity runtime T2 was less than the predetermined time period at state 170, the control module 22 may continue to operate the compressor 12 in the low-capacity mode (state 120) until the cooling demand is satisfied, until the total runtime T of the compressor 12 since the receipt of the demand signal Y surpasses the predetermined low-capacity runtime T1, or until the algorithm 100 is overridden.

When the system 10 is in the heating mode, the algorithm 100 may operate similarly or identically as described above, except the condition to be satisfied before the algorithm enters state 160 would be: whether the outdoor ambient air temperature is less than a second predetermined temperature value. The second predetermined temperature value when the system 10 is in the heating mode may be different than the first predetermined temperature value in the cooling mode. For example, the second predetermined temperature value in the heating mode may be about forty degrees Fahrenheit, for example. Therefore, in the heating mode, if the control module 22 determines that the outdoor ambient air temperature is above the second predetermined temperature value, the control module 22 may continue to operate the compressor 12 in the low-capacity mode (state 120) until heating demand is satisfied, until the runtime T surpasses the predetermined low-capacity runtime T1, or until the algorithm 100 is overridden. If, in the heating mode, the control module 22 determines that the outdoor ambient air temperature is less than the second predetermined temperature value, the algorithm 100 may enter state 160. From state 160, the algorithm 100 may operate similarly or identically as described above with respect to the cooling mode. It is contemplated that for many houses or buildings, operation in the low-capacity mode in the heating mode may be sufficient to satisfy heating demand while outdoor-air temperatures are at or above forty degrees Fahrenheit, and high-capacity mode operation may not be necessary or desirable until outdoor-air temperatures fall below forty degrees Fahrenheit.

Below a third predetermined outdoor-air temperature (e.g., twenty degrees Fahrenheit), many heat-pump systems may not have sufficient capacity to satisfy heating demand even if continuously operating in the high-capacity mode. Therefore, alternative or supplemental heating systems may be employed instead of or in addition to such heat-pump systems. Below this third predetermined temperature, the control module 22 may cause the compressor 12 to run in the high-capacity mode for a third predetermined runtime (e.g. thirty minutes) before turning on the alternative or supplemental heating systems.

As described above, the variable-capacity compressor 12, control module 22 and algorithm 100 are capable of operating with a single-stage indoor thermostat 26 and an indoor unit 30 with a fixed-speed blower 19. Therefore, the control module 22 and algorithm 100 of the present disclosure allow a pre-existing climate control system having a fixed-capacity to be retrofitted to include the variable-capacity compressor 12 and control module 22 without also retrofitting the system to include a multi-stage thermostat and/or an indoor unit having a multi-speed blower. Retrofitting a fixed-capacity climate control system to include the variable-capacity compressor 12 and control module 22 without also replacing the single-stage thermostat 26 and fixed-speed blower 19 improves the performance and efficiency of the climate-control system without the added significant expense and complexity associated with retrofitting the climate-control system to include a multi-stage thermostat and/or an indoor unit having a multi-speed blower. Alternatively, a multi-stage thermostat could be employed, where the multi-stage thermostat is only connected to transmit a single demand signal (e.g., only one demand wire is connected to the compressor 12 and/or control module 22, as opposed to having both of a low-capacity demand wire and a high-capacity demand wire connected to the compressor 12 and/or control module 22).

It will be appreciated that the first and second predetermined temperature values, the predetermined low-capacity runtime T1, the predetermined waiting period, and/or the predetermined time period described above may be chosen based on climate, geographical location, tonnage size of the compressor 12 relative to the thermal load of the house or building 32 and/or whether the system is operating in the cooling mode or the heating mode.

In some embodiments, the outdoor-air temperature used in the algorithm 100 may not necessarily be an instantaneous or real-time temperature value. Instead, the control module 22 may acquire or determine an average outdoor-air temperature over previous operating cycles or over certain time periods to account for the effect of solar radiation and/or a thermal mass of the building 32 or the space to be heated or cooled.

In some embodiments in which the control module 22 receives the outdoor-air temperature from a remote weather-reporting and/or weather-forecasting database or source, the control module 22 may be configured to record high-capacity-mode operating history versus outdoor-air temperature history and time of day. In such embodiments, the control module 22 may be configured to anticipate expected future days and times to switch to the high-capacity mode based on forecasted outdoor-air temperatures and the recorded operating history versus outdoor-air temperature history and time of day.

Figure 3:
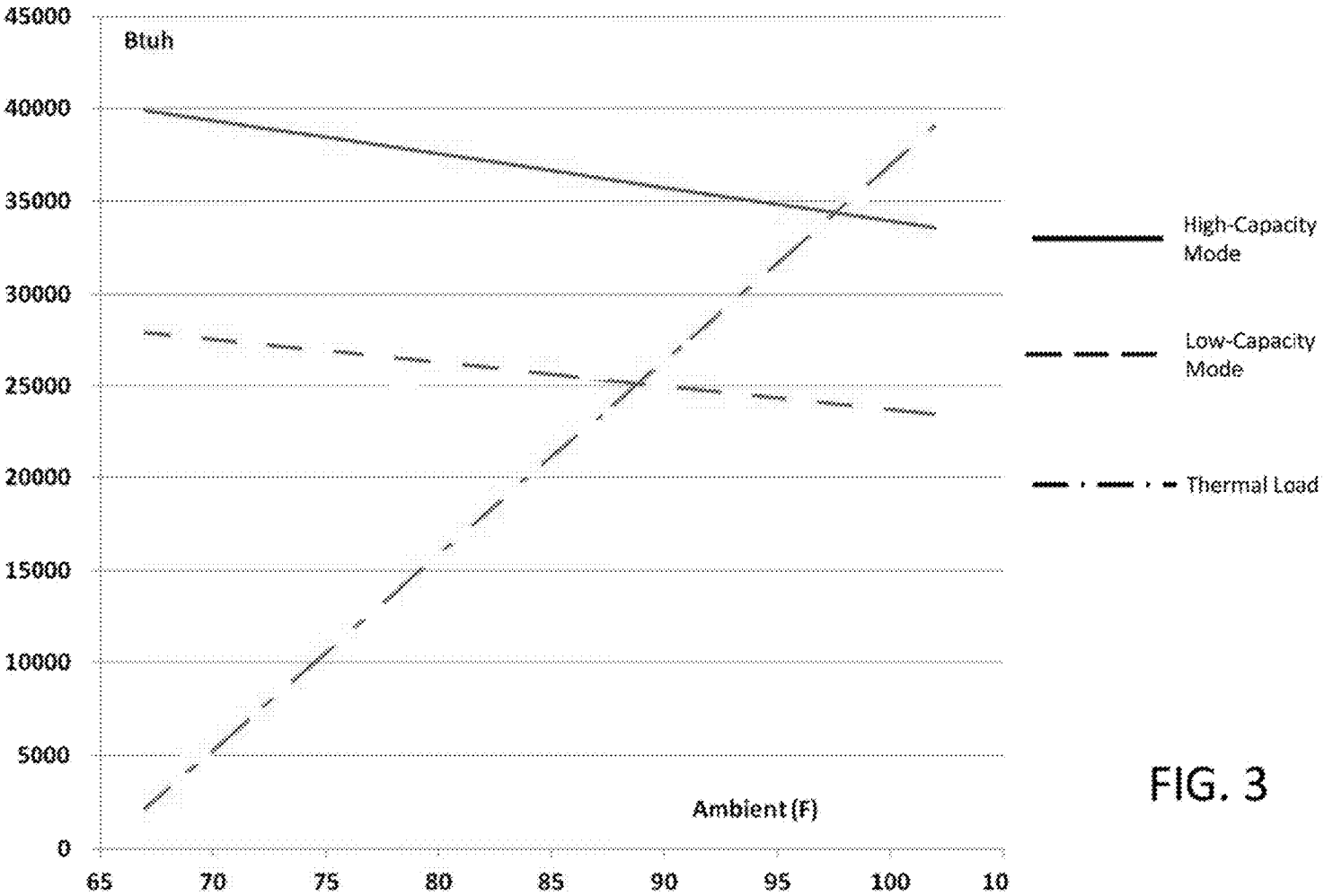
FIG. 3 is a graph showing relationships between low-capacity and high-capacity levels of a compressor, thermal load of a house and outdoor-air temperature for an exemplary climate-control system sized for an exemplary house in an exemplary climate.
Figure 4:
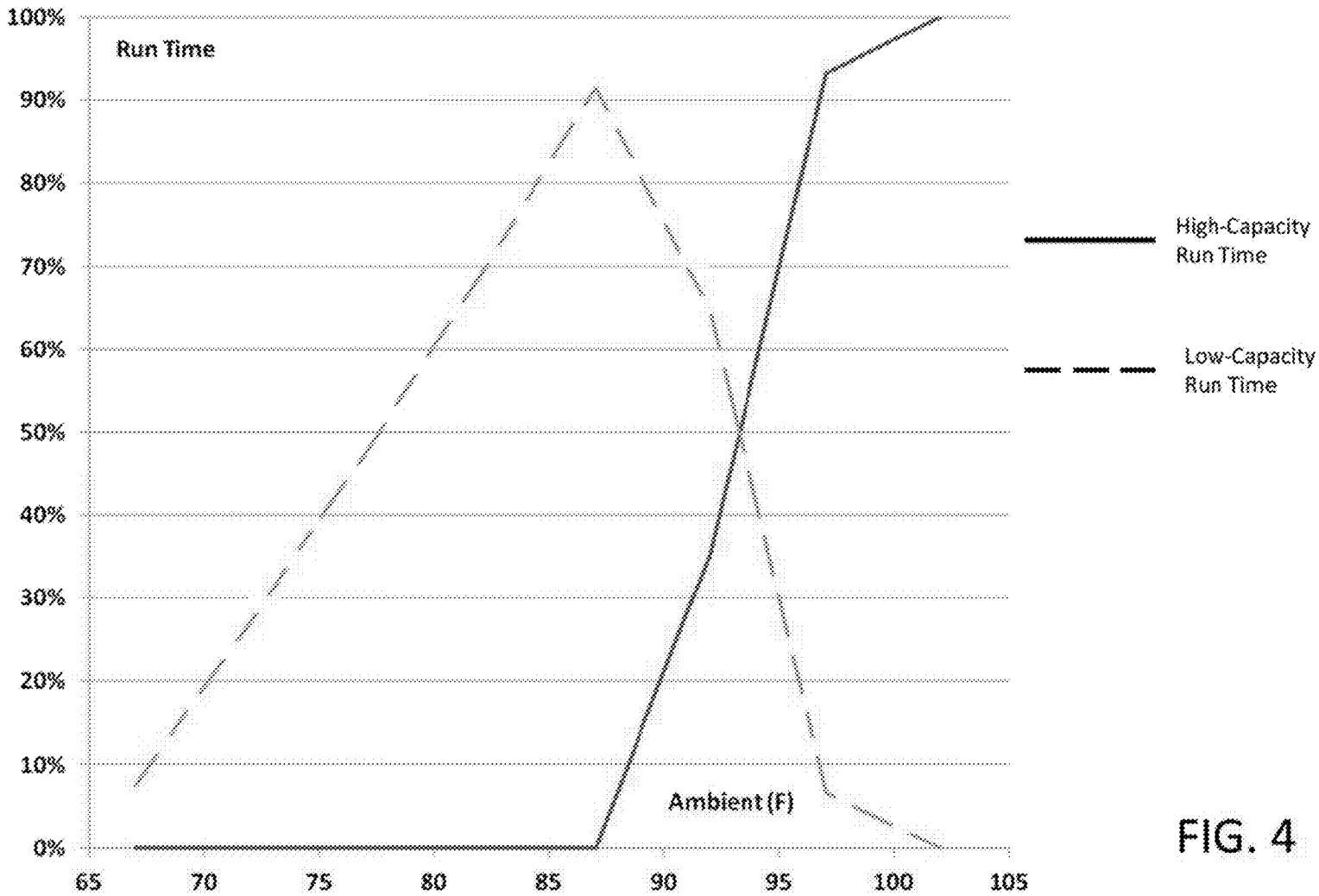
FIG. 4 is a graph showing run-time percentages of the low-capacity and high-capacity modes for a range of outdoor-air temperatures.
Figure 5:
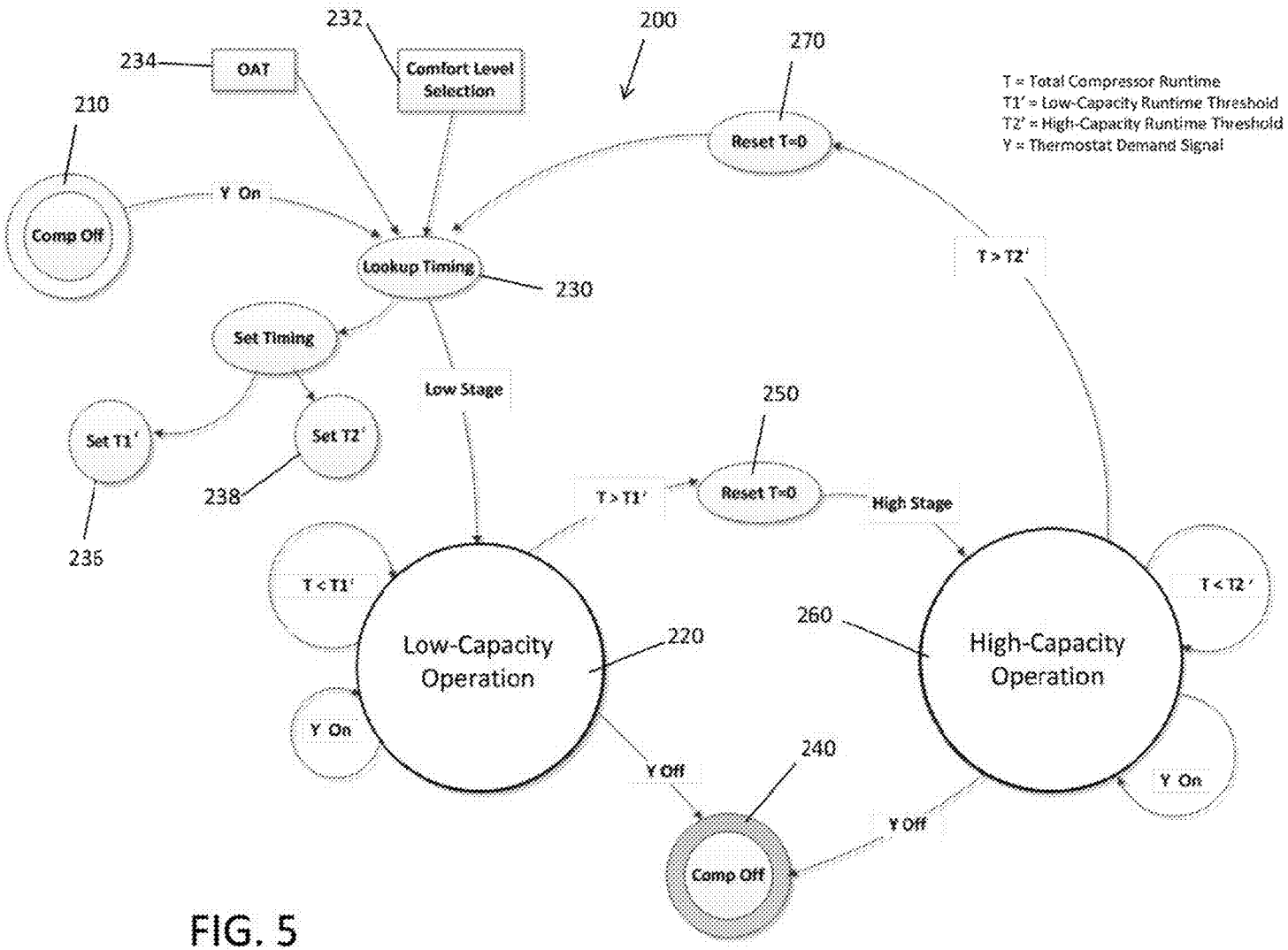
FIG. 5 is a state diagram illustrating another method and algorithm for controlling the variable-capacity compressor of FIG. 1.

FIG. 3 is a graph illustrating capacities of an exemplary variable-capacity compressor in the low and high-capacity modes at various outdoor-air temperatures and a thermal load of an exemplary house at various outdoor-air temperatures. FIG. 4 is a graph illustrating the percent runtime of the compressor in the low-capacity and high-capacity modes. When the outdoor-air temperature is within a range over which the thermal load of the house is less than the compressor capacity in the low-capacity mode, the control module 22 may operate the compressor only in the low-capacity mode. When the outdoor-air temperature is within a range over which the thermal load of the house is higher than the compressor capacity in the low-capacity mode and is lower than the compressor capacity in the high-capacity mode, the control module 22 may switch the compressor between the low-capacity and high-capacity modes to satisfy the demand. When the outdoor-air temperature is within a range over which the thermal load of the house is higher than the compressor capacity in the high-capacity mode, the control module 22 may operate the compressor exclusively or nearly exclusively in the high-capacity mode.

The percent runtime shown in FIG. 4 may be derived as the ratio of thermal load of the house over unit capacity for each capacity stage at a given outdoor ambient temperature shown in FIG. 3. Based on experimentation, the predetermined runtime T1 (e.g., forty minutes) may be chosen to represent a maximum runtime in the low-capacity mode that is desirable or acceptable before it would be desirable to switch to the high-capacity mode. The predetermined runtime T1 may vary depending on the relative capacities of the compressor in the low-capacity and high-capacity modes relative to the thermal load of the house. FIG. 3 is based on a sizing rule with the high-capacity mode being about 10 percent higher than the thermal load of the house at an ambient temperature of ninety-five degrees. The predetermined ambient temperature where the high-capacity stage would start operating may be in the range of eighty five to ninety degrees Fahrenheit.

With reference to FIGS. 1 and 5-11, another method and control algorithm 200 of the control module 22 will be described. The algorithm 200 may control operation of the compressor 12 and switch the compressor 12 between the low-capacity and high-capacity modes. In an initial state 210, the compressor 12 may be off. The thermostat 26 may send a demand signal Y to the control module 22 in response to an air temperature in the space to be heated or cooled by the system 10 dropping below (in the heating mode) or rising above (in the cooling mode) a selected setpoint temperature. In response to receipt of the demand signal Y, the control module 22 may initiate operation of the compressor 12 in the low-capacity mode (state 220). As described above, initiating operation of the compressor 12 in the low-capacity mode may reduce or minimize an in-rush of energy and mechanical stress during start-up of the compressor 12.

After receipt of the demand signal Y, the control module 22 may (prior to, concurrently with or after initial startup of the compressor 12 at state 220) determine and set a low-capacity runtime threshold T1' and a high-capacity runtime threshold T2'. At state 230, the control module 22 may determine the runtime thresholds T1', T2' based on an outdoor ambient air temperature (input 232) and a comfort level selection (input 234). As described above, the outdoor ambient air temperature may be received from the outdoor-air-temperature sensor 24. The comfort level selection may be received from a comfort control interface 225 (FIG. 11) that is in communication with the control module 22.

In some configurations, the comfort control interface 225 may include a dial 227, for example, that is movable among a plurality of positions. In the particular configuration shown in FIG. 11, the dial 227 is movable among five different positions, each corresponding to a different one of comfort levels 1-5 (indicated by indicia 229 in FIG. 11). The comfort control interface 225 may be in communication with the control module 22 via a wired or wireless connection. For example, the comfort control interface 225 could be in communication with the control module 22 via an internet connection (wired or wireless), a cellular connection, Bluetooth® connection, radio-frequency signals, infrared signals and/or any other suitable means. In some configurations, the user control interface 225 may include one or more buttons, switches, and/or touchscreen interfaces instead of or in addition to the dial 227. In some configurations, the comfort control interface 225 could be, include or be a part of the thermostat 26, a computer, a smartphone, or a tablet, for example, or any other computing, control and/or communication device.

The comfort level interface 225 allows a user to adjust the low-capacity and high-capacity runtime thresholds T1', T2' to adjust the energy-efficiency and performance of the system 10. In the configuration illustrated in the figures, comfort level 1 is a setting that reduces the amount of time that the compressor 12 can run in the high-capacity mode and increases the amount of time that the compressor 12 can be operated in the low-capacity mode, thereby increasing the energy-efficiency of the system 10. Comfort level 5 is a setting that increases the amount of time that the compressor 12 can run in the high-capacity mode and decreases the amount of time that the compressor 12 can run in the low-capacity mode, thereby increasing the performance of the system 10 (i.e., increasing the ability of the system 10 to more quickly cool or heat a space).

FIGS. 6 and 7 depict first and second lookup tables 231, 233 that provide exemplary low-capacity and high-capacity runtime thresholds T1', T2' for given outdoor ambient air temperatures (or ranges of temperatures) for each of five comfort levels. The values of the lookup tables 231, 233 may be stored in a memory unit associated with the control module 22 and/or on a memory unit associated with any of a computer, a tablet, a smartphone, any handheld device, a cloud (i.e., an internet-connected server) and/or any suitable computing and/or memory device that can be configured to communicate with the control module 22. As shown in FIGS. 6 and 7, for each given outdoor ambient air temperature, the low-capacity runtime threshold T1' decreases as the comfort level increases from comfort level 1 to comfort level 5, and the high-capacity runtime threshold T2' increases as the comfort level increases from comfort level 1 to 5. The exemplary lookup tables 231, 233 shown in FIGS. 6 and 7 are used while the system 10 is operating in the cooling mode. Additional tables (not shown) may be stored in the memory unit of the control module 22 for use in a heating mode. Such additional tables may include different values than those provided in tables 231, 233.

At state 230, the control module 22 may determine the low-capacity and high-capacity runtime thresholds T1', T2' for the outdoor ambient-air-temperature received at input 234 and the comfort level selection received at input 232 based on the tables 231, 233. Then, at states 236, 238, the control module 22 may set the thresholds T1', T2', respectively, to the values determined at state 230. It will be appreciated that the control module 22 could apply a formula or a series of calculations to determine the runtime thresholds T1', T2' rather than referencing lookup tables 231, 233.

The compressor 12 may continue to run in the low-capacity mode (state 220) as long as the demand signal Y is on and as long as a total runtime T of the compressor 12 since initial receipt of the demand signal Y is less than the low-capacity runtime threshold T1' that was set at state 236. If the demand signal Y is turned off, then the control module 22 may shut the compressor 12 off at state 240. If and when the total runtime T surpasses the low-capacity runtime threshold T1', the control module 22 may reset the total runtime T to zero (state 250) and switch the compressor 12 to the high-capacity mode (state 260). The compressor 12 may continue to run in the high-capacity mode (state 260) as long as the demand signal Y is on and as long as a total runtime T is less than the high-capacity runtime threshold T2' that was set at state 238. If and when the total runtime T surpasses the high-capacity runtime threshold T2', the control module 22 may reset the total runtime T to zero (state 270) and the algorithm 200 may return to state 230 to determine and set the low-capacity and high-capacity runtime thresholds T1', T2' before returning the compressor 12 to the low-capacity mode at state 220. Thereafter, the algorithm 200 may repeat some or all of the steps described above until the demand signal Y is turned off or until operation of the compressor 12 is overridden (e.g., manually overridden or overridden by a compressor protection routine, for example).

Figure 8:
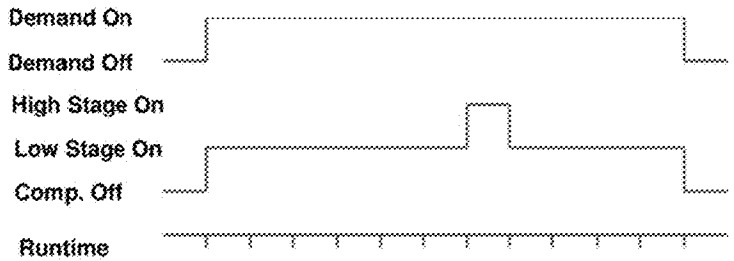
FIG. 8 is a graph depicting low-capacity and high-capacity runtimes during operation at a first comfort level.
Figure 9:
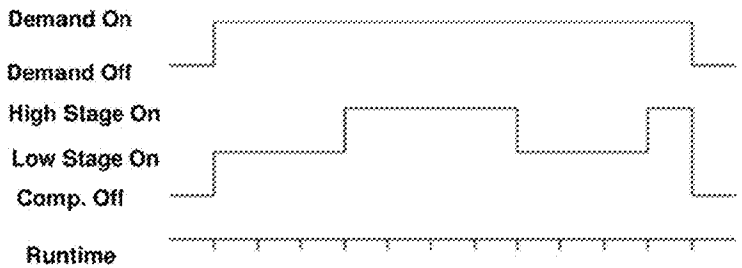
FIG. 9 is a graph depicting low-capacity and high-capacity runtimes during operation at a second comfort level.
Figure 10:
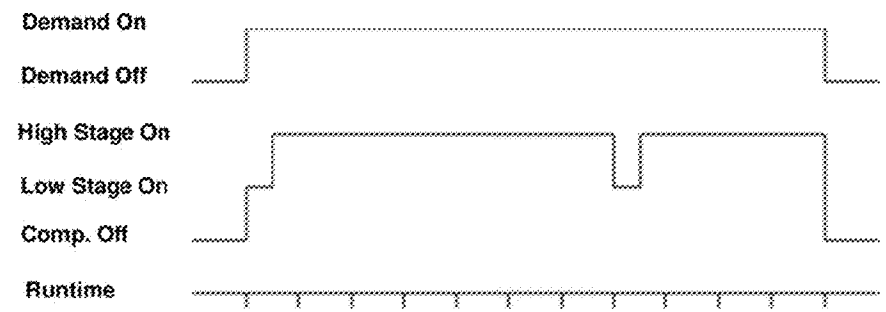
FIG. 10 is a graph depicting low-capacity and high-capacity runtimes during operation at a third comfort level.
Figure 11:
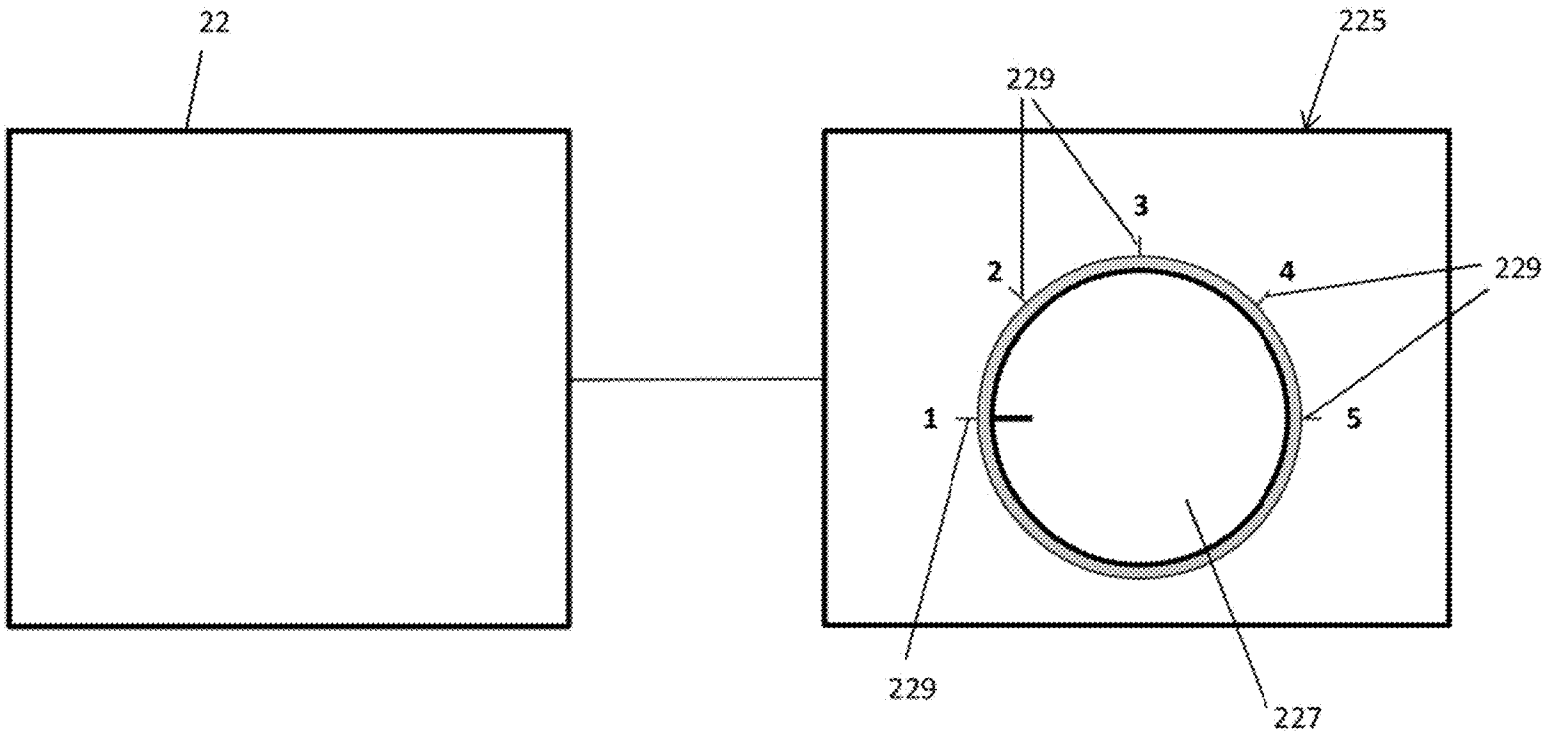
FIG. 11 is a schematic representation of a comfort control interface and a control module.

FIGS. 8-10 depict runtimes of the compressor 12 in the low-capacity and high-capacity modes for various comfort levels. FIG. 8 depicts the low-capacity and high-capacity runtimes for a low comfort level (e.g., comfort level 1). FIG. 9 depicts the low-capacity and high-capacity runtimes for an intermediate comfort level (e.g., comfort level 3). FIG. 10 depicts the low-capacity and high-capacity runtimes for a high comfort level (e.g., comfort level 5). As shown in FIGS. 8-10, higher comfort level settings allow the compressor 12 to run longer in the high-capacity mode, which improves the performance of the system 10. Lower comfort level settings cause the compressor 12 to run longer in the low-capacity mode, which improves the energy-efficiency of the system 10 by reducing power consumption. As shown in FIGS. 8-10, operating time in the low-capacity mode decreases as the comfort level is increased.

It will be appreciated that the comfort level could be changed at any point during the algorithm 200 and the low-capacity and high-capacity runtime thresholds T1', T2' could be immediately updated in response to a change in the comfort level.

In some configurations, the control module 22 may adjust the runtime thresholds T1', T2' based on a weather forecast and/or current weather conditions such as humidity, cloud-cover and/or precipitation, for example. In some configurations, the control module 22 may increase the low-capacity runtime threshold T1' and/or decrease the high-capacity runtime threshold T2' for a given comfort level if current weather conditions include low humidity, significant cloud-cover and/or rain. In some configurations, the control module 22 may adjust the values of the tables 231, 233 (or utilize different tables in the algorithm 200) based on a climate of a particular geographical region in which the system 10 will be installed. For example, the comfort control interface 225 or the thermostat 26 could be configured to allow the user or installation contractor to input the geographical region or climate type in which the system 10 is installed. In some configurations, the control module 22 may adjust the values of the tables 231, 233 based on historical data such as previous runtimes, previous outdoor-ambient-air temperatures and/or other previous weather conditions. In some configurations, values of the tables 231, 233 could be adjusted based on current or predicted future energy costs. In some configurations, a baseline set of values for the tables 231, 233 could be stored in the memory unit for future use.

In some configurations, the comfort level may be a parameter that is set by an installation contractor or by a service contractor at the time of installation of the system 10 or service of the system 10. In some of such configurations, the comfort level selection may not be readily adjusted by a homeowner and/or occupants of the home or building. In some configurations, an electrical utility company or entity may have the ability to set and adjust the comfort level selection and/or the ability to override a comfort level selection made by the homeowner and/or home/building occupant, for example. In such configurations, the utility may select a comfort level that uses a lower amount of electricity during periods of high demand for electrical power in an area or community in which the home or building 32 is situated.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of controlling a compressor operable in a first capacity mode and in a second capacity mode that is higher than the first capacity mode, the method comprising:

receiving a demand signal from a thermostat;

selecting one of a plurality of low-capacity runtime threshold values based on a selected one of a plurality of comfort levels, wherein each of the comfort levels corresponds to a different one of the low-capacity runtime threshold values;

operating the compressor in a low-capacity mode in response to receipt of the demand signal;

comparing a runtime of the compressor to the selected one of the low-capacity runtime threshold values; and switching the compressor from the low-capacity mode to a high-capacity mode based on the comparison of the runtime and the selected one of the low-capacity runtime threshold values.

2. The method of claim 1, further comprising setting a high-capacity runtime threshold value based on the selected one of the comfort levels.

3. The method of claim 2, further comprising switching the compressor from the high-capacity mode to the low-capacity mode based on the comparison of the runtime and the high-capacity runtime threshold value.

4. The method of claim 1, further comprising setting a setpoint temperature at which the demand signal will be transmitted.

5. The method of claim 1, wherein the comfort level settings are set based on one of a geographical region in which the compressor is installed and a climate type in which the compressor is installed.

6. The method of claim 1, wherein the selected one of the comfort levels is set using a comfort control interface configured to be set at one of the plurality of comfort level settings, wherein a first one of the comfort level settings corresponds to an energy-efficiency operating mode and a second one of the comfort level settings corresponds to a high-performance operating mode.

7. The method of claim 6, wherein the comfort control interface includes at least another comfort level setting between the first and second ones of the comfort level settings.

8. The method of claim 6, wherein the comfort control interface is configured to be manually positioned at one of the plurality of comfort level settings.

9. The method of claim 6, wherein the low-capacity runtime threshold value is greater when the comfort control interface is set at the first one of the comfort level settings than when the comfort control interface is set at the second one of the comfort level settings.

10. The method of claim 1, wherein the thermostat is a single-stage thermostat.

* * * * *